US006563488B1

(12) United States Patent
Rogers et al.

(10) Patent No.: US 6,563,488 B1
(45) **Date of Patent: *May 13, 2003**

(54) POINTING DEVICE WITH INTEGRATED SWITCH

(75) Inventors: Michael D. Rogers, El Dorado Hills, CA (US); Allan E. Schrum, Cameron Park, CA (US)

(73) Assignee: Varatouch Technology Incorporated, Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/509,655

(22) PCT Filed: Sep. 24, 1998

(86) PCT No.: PCT/US98/20203

§ 371 (c)(1),
(2), (4) Date: Jun. 9, 2000

(87) PCT Pub. No.: WO99/17180

PCT Pub. Date: Apr. 8, 1999

Related U.S. Application Data

(63) Continuation-in-part of application No. 09/132,563, filed on Aug. 11, 1998, and a continuation-in-part of application No. 09/056,387, filed on Apr. 7, 1998, and a continuation-in-part of application No. 08/939,377, filed on Sep. 29, 1997.

(51) Int. Cl.[7] ..... G09G 5/08

(52) U.S. Cl. ..... 345/163; 345/156; 345/161; 345/162; 345/164

(58) Field of Search ..... 345/156, 157, 345/161, 162, 163, 164, 168; 200/5 R, 512, 17 R, 6; 341/20

(56) References Cited

U.S. PATENT DOCUMENTS

| | | | | | |
|---|---|---|---|---|---|
| 4,349,708 | A | * | 9/1982 | Asher | 200/17 R |
| 5,828,364 | A | * | 10/1998 | Siddiqui | 200/5 R |
| 5,982,355 | A | * | 11/1999 | Jaeger et al. | 345/161 |
| 6,067,005 | A | * | 5/2000 | DeVolpi | 200/512 |
| 6,184,866 | B1 | * | 2/2001 | Schrum et al. | 345/157 |
| 6,256,013 | B1 | * | 7/2001 | Siddiqui | 341/20 |

* cited by examiner

*Primary Examiner*—Vijay Shankar
*Assistant Examiner*—Prabodh Dharia
(74) *Attorney, Agent, or Firm*—Townsend and Townsend and Crew LLP

(57) ABSTRACT

A pointing device comprises a substrate with an electrically conductive surface (36) and a resilient return member (12). The return member resiliently supports a resistive surface (20) to contact the electrically conductive surface (36) in a pressed mode when a force (23) is applied to push and deform the return member against the electrically conductive surface. The return member (12) is made of a resistive rubber material. The resistive surface (20) has a voltage variance and is curved to be rocked on the electrically conductive surface (36) in the pressed mode. The voltage variance is detected on the electrically conductive (20) surface and a variable signal is generated and processed. In a specific embodiment, a dome switch is disposed between the resistive surface and the electrically conductive surface to provide a drag function.

41 Claims, 6 Drawing Sheets

POINTING DEVICE WITH INTEGRATED SWITCH

This application is a continuation-in-part of, and claims priority from, U.S. patent application Ser. No. 08/939,377, filed Sep. 29, 1997; U.S. patent application Ser. No. 09/056,387, filed Apr. 7, 1998; and U.S. patent application Ser. No. 09/132,563, filed Aug. 11, 1998. The entire disclosures of these commonly assigned applications are incorporated herein by reference.

BACKGROUND OF THE INVENTION

This invention relates generally to pointing devices and, more particularly to an improved pointing device which includes a resistive resilient force member with an integrated switch and an electrically conductive substrate surface.

Pointing devices including joysticks are known in the art. Traditional joysticks have been used primarily as a gaming controller, although they have also been employed as general mouse replacement devices. In a typical application, the joystick pointing device is connected via cables to a microcontroller of a computer with a display and a keyboard. The traditional joystick has many moving parts, and the size of the mechanism therein prohibits its use in many applications, including remote controls, keyboards, and notebooks. On the other hand, joysticks have the advantages of reliability and performance.

Prior pointing devices typically employ a substrate or printed circuit board having a resistive coating and a conductive force diverter that is movable on the substrate to change the location of contact and produce signals that vary with location. Forming the resistive coating on the substrate is a costly and problematic procedure that can result in a high percentage of devices that must be scrapped.

SUMMARY OF THE INVENTION

There is therefore a need for a simply structured pointing device that has fewer components and fewer moving parts, has high performance and reliability, and is easy to manufacture.

It is a feature of this invention to provide a compact, simply structured pointing device that includes a reduced number of components and only one moving part, and that is miniaturized.

It is another feature of this invention to provide a pointing device that can be built into a notebook or standard computer, or used for remote control devices.

It is another feature of this invention to provide a pointing device that is impervious to the external environment.

It is another feature of the invention to provide a pointing device with digital and analog integration including a digital switch and/or wake-up feature for conserving battery life which is ideal for remote control application.

It is yet another feature of the invention to provide different types of control surfaces for the user to contact and manipulate the pointing device.

One aspect of the present invention is a pointing device which comprises a substrate having an electrically conductive surface and a resilient boot supported by the substrate along an outer edge. The resilient boot is spaced from the electrically conductive surface in a rest mode. The resilient boot is displaceable relative to the substrate by a force and resiliently returns to the rest position with removal of the force. The resilient boot has a voltage variance over a resistive rocking surface of the resilient boot. The resistive rocking surface is displaceable to contact a portion of the electrically conductive surface at an electrical contact position to generate a signal through the electrically conductive surface with the voltage variance in a pressed mode. The resistive rocking surface is displaceable to rock on the electrically conductive surface to change the electrical contact position between the resistive rocking surface and the electrically conductive surface to produce a corresponding change in the signal. A built-in dome switch with associated firmware can be used to provide a switch and/or drag function for the pointing device.

Another aspect of the invention is a pointing device comprising an electrically conductive surface and a diverter. The diverter includes a resistive rolling surface having a voltage variance and means for resiliently supporting the resistive rolling surface in an undeflected mode spaced from the electrically conductive surface. The resistive rolling surface is movable to contact a portion of the electrically conductive surface in a deflected mode. The resistive rolling surface is movable to roll over the electrically conductive surface to contact a different portion of the electrically conductive surface.

In accordance with another aspect of this invention, an electrically conductive surface is provided in a pointing device for contacting a resistive surface having a voltage variance when the resistive surface is pushed toward the electrically conductive surface and rolled to transfer the voltage variance. The electrically conductive surface comprises at least one inner switch and an outer conductive region. A nonconductive gap separates each inner switch from the outer conductive region.

DESCRIPTION OF THE PREFERRED EMBODIMENT

Figure 1:
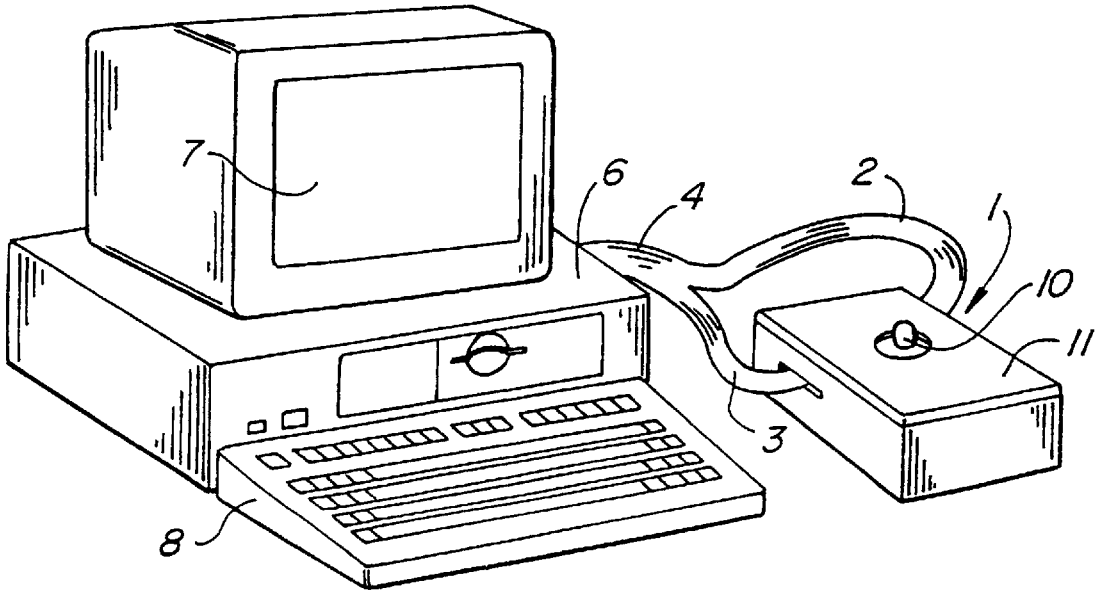
FIG. 1 is a perspective view illustrating a pointing device of the present invention connected to a computer system.

Referring to FIG. 1, a pointing device is shown contained in a container or box 1 having a top wall or cover 11. Although FIG. 1 shows a joystick pointing device 10, the present invention is not limited to joysticks. A pair of cables 2, 3 are coupled to the container 1 and extend from the container 1 to a junction at which the cables 2, 3 join together in a cable 4 that is connected to a microcontroller 6. The microcontroller 6 is associated with a monitor 7 and a keyboard 8.

Figure 2:
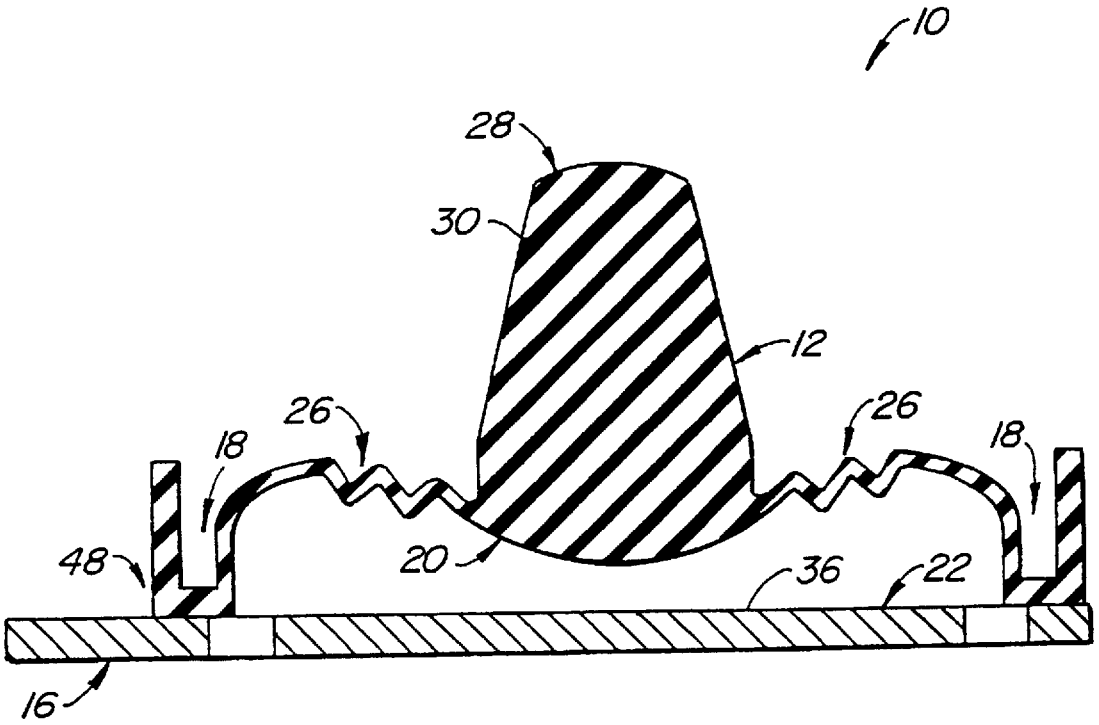
FIG. 2 is a partial cross-sectional view illustrating an embodiment of a pointing device of the present invention in an undeflected mode.

One embodiment of the pointing device 10 of FIG. 2 includes a resilient boot or return member 12 supported on a nonconductive substrate 16. The resilient boot 12 is desirably connected to the substrate 16 along its outer edge 18. The outer edge 18 may have any shape, and desirably is substantially circular. The resilient boot 12 is also desirably a generally circular member with cross-sections through its center having the shape shown in FIG. 2.

The resilient boot 12 has a resistive surface 20 spaced from the upper surface 22 of the substrate 16. The resistive surface 20 is resiliently supported to be movable or displaceable between the rest mode or undeflected mode shown in FIG. 2 and the pressed mode or deflected mode shown in FIG. 3, in which the resistive surface 20 is pressed in the direction of the arrow 23 to make contact with the upper surface 22 of the substrate 16 to form a contact location 24. The resilient boot 12 advantageously includes a flexible member or support 26 that resiliently supports the resistive surface 20 to move between the rest mode and the pressed mode. The flexible member 26 is connected between the resistive surface 20 and the outer edge 18 of the resilient boot 12. One embodiment of the flexible member 26 is an annular bellow shown in FIGS. 2 and 3. The annular bellow 26 deforms in an accordion-like manner upon the application of a force on the resilient boot 12 to move the resistive surface 20 toward the substrate 16. It is understood that other flexible members may be used to resiliently support the resistive surface 20.

The resistive surface 20 desirably is curved to roll or rock on the upper surface 22 of the substrate 16 in the pressed mode. The resistive surface 20 desirably has a convex shape. As the resistive rocking surface 20 rocks on the upper surface 22, the contact location 24 between the resistive surface 20 and the upper surface 22 is changed. The resistive surface 20 may be deformable such that the contact location 24 between the resistive surface 20 and the upper surface 22 increases in area with an increased deflection caused by a larger force exerted on the resilient boot 12. The resistive surface 20 comprises a resistive material which is desirably a resistive rubber. Advantageously, the resistance over the resistive surface 20 is substantially uniform.

As shown in FIG. 2, the resilient boot 12 advantageously includes a stick or joystick 28 extending from the resistive surface 20. The stick 28 is operable by a human hand or finger(s) to press the resistive surface 20 toward the substrate 16. In the preferred embodiment, the stick 28 extends generally perpendicularly to the upper surface 22 of the substrate 16, although other orientations for the stick 28 are acceptable. The stick 28 desirably has a tapered side surface 30 for comfort and ease in handling. The stick 28 may be made of a variety of materials, including rubber or plastic.

The stick 28, resistive surface 20, and flexible member 26 may be made of the same material, desirably a resistive, low durometer rubber. The resistive rubber may include a resistive material, such as carbon or a carbon-like material, imbedded in a rubber material. The resistive rubber advantageously has a substantially uniform or homogeneous resistance, which is typically formed using very fine resistive material that is mixed for a long period of time in the forming process. In most applications, the resistive rubber used has a moderate resistance below about 50 thousand ohms and more desirably below about 25 thousand ohms, for instance, between about 1,000 and about 25,000 ohm, and most desirably between about 1,000 and 10,000 ohms. The resistive rubber boot 12 formed by the stick 28, resistive surface 20, and flexible member 26 may be made, for instance, by molding.

Figure 3:
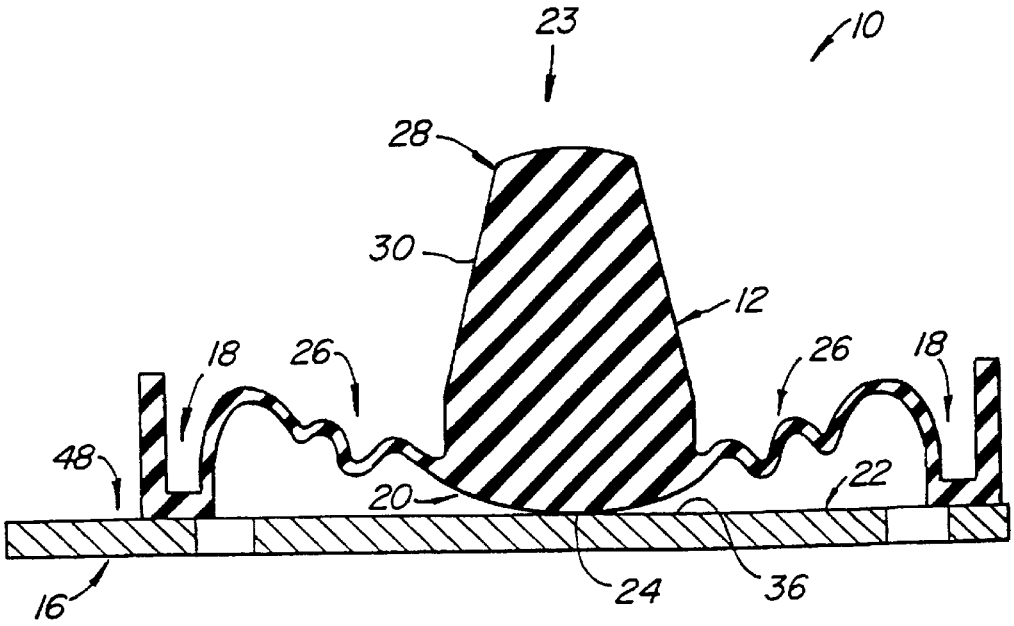
FIG. 3 is a partial cross-sectional view illustrating the pointing device of FIG. 2 in a deflected mode.
Figure 4:
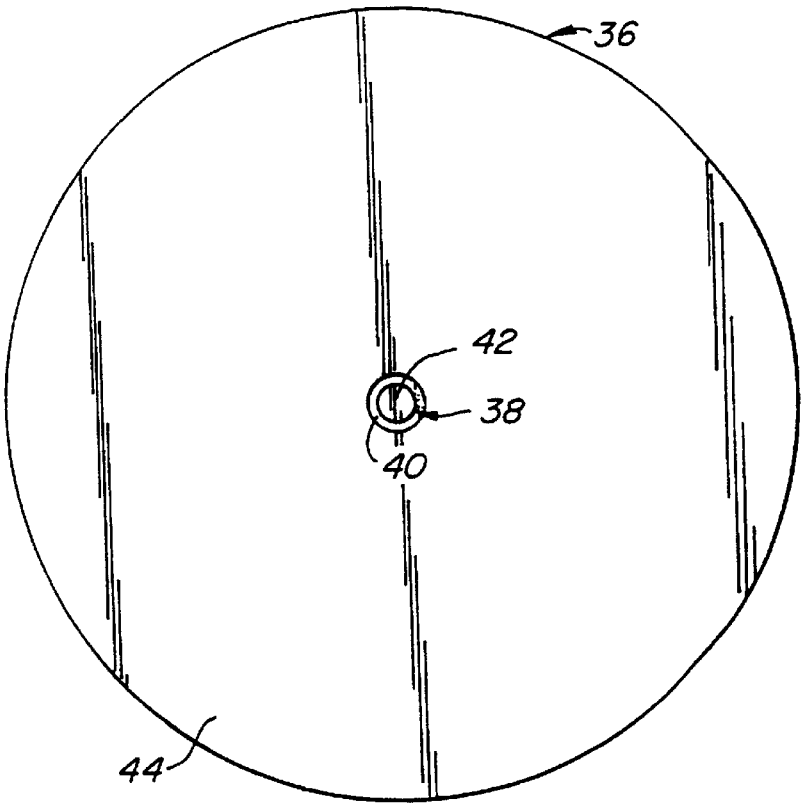
FIG. 4 is a plan view of an embodiment of an electrically conductive surface on a substrate of the pointing device of FIG. 2.

The upper surface 22 of the substrate 16 comprises an electrically conductive surface 36 on which the resistive surface 20 of the resilient boot 12 contacts in the pressed mode. As shown in FIGS. 2–4, the electrically conductive surface 36 is desirably planar in shape and substantially circular. The electrically conductive surface 36 has a conductive material such as copper.

Referring to FIG. 4, an embodiment of the electrically conductive surface 36 may include a switch 38, which desirably is an inner switch 38 that comprises an electrically conductive center 42 separated from an electrically conductive annulus 44 by a nonconductive electrical switch gap or ring 40. The nonconductive ring 40 may be formed by part of the substrate. The area of the electrically conductive center 42 and the width of the nonconductive electrical switch ring 40 are desirably small compared to the area of the resistive surface 20. Advantageously, the resistive surface 20 can be deflected by a human hand or finger(s) to make contact with the electrically conductive surface 36 over a contact location 24 that includes both the electrically conductive center 42 and the electrically conductive annulus 44 across the nonconductive ring 40. In a preferred embodiment, the electrically conductive center 42 is located at the center of the electrically conductive surface 36 which is spaced from the resistive surface 20 by the shortest distance and aligned with the axis of the stick 28.

In use, a voltage variance is provided over the resistive surface 20, and desirably over the resistive resilient boot 12. The voltage variance can be produced by any method known in the art. For example, the voltage variance can be created by electrically contacting the resistive resilient boot 12 with a plurality of electrical contacts 48 spaced along its outer edge 18. There are at least two, and desirably four (e.g., east, west, north, south), such electrical contacts 48. Each pair of opposite electrical contacts 48 are energized with a voltage potential. The voltage-potential-energized electrical contacts 48 produce a voltage variance across the resistive surface 20 of the resistive resilient boot 12. In applications where the pointing device 10 is used with microprocessors, the typical voltage applied to the electrical contacts 48 is about 3–5 volts. The voltage can be different for other applications.

When the stick 28 of the resilient boot 12 is pushed toward the substrate 16 as illustrated in FIG. 3, the flexible member 26 deforms in an accordion-like manner and an electrical contact location 24 is created between the resistive surface 20 and the electrically conductive surface 36 in the pressed mode. The resilient boot 12 functions as force diverter. In the pressed mode, the resistive surface 26 transfers a voltage to the electrically conductive surface 36 with a resistive value determined by the electrical contact location 24 on the resistive surface 20.

When the resistive surface 20 is rocked or rolled on the electrically conductive surface 36 or pressed to deform further by a stronger force, the electrical contact location 24 is transferred and the area of contact is changed. The change in the contact location 24 and area causes a voltage variation due to the change in the resistive value of a different contact location 24 and area on the resistive surface 20. By rocking the resistive surface 20 over the electrically conductive surface 36, the voltage variance of the resistive surface 20 can be detected on the electrically conductive surface 36. The signal is received and processed by a device such as a microcontroller (not shown) which interprets the signal data and generates an output to a relevant receiver such as a display (not shown). Using methods known in the art, the detected information can be used to calculate the location of contact 24 between the resistive surface 20 and the electrically conductive surface 36. The resilient boot 12 returns to its original undeformed position with the resistive surface 20 spaced from the electrically conductive surface 36 when the force is removed.

If the electrically conductive surface 20 has the configuration shown in FIG. 4, the electrical switch 38 is activated when the resilient boot 12 is deflected in the pressed mode. Because the stick 28 is aligned with the switch 38, the force applied on the stick 28 generally transfers down the axis of the stick 28 toward the switch 38. As the resistive surface 20 electrically contacts the electrically conductive center 42 and the electrically conductive annulus 44 by bridging the nonconductive gap or ring 40, the switch 38 is activated. The switch 38 may be used for a range or applications as known to those of ordinary skill in the art, such as mouse clicks.

When the pointing device 10 is used in applications such as a remote control device, where conservation of battery power is desired, the pointing device 10 desirably includes a digital wake up feature. In this case, the voltage variance is not applied to the resistive surface 20 when the pointing device 10 is in the rest mode. The voltage variance is applied only when there is electrical contact between the resistive surface 20 and the electrically conductive surface 36 in the pressed mode and a digital wake up signal is produced. As a result, energy is conserved and the battery life can be extended. Details of a digital wake up device are known in the art and not repeated here.

Figure 5:
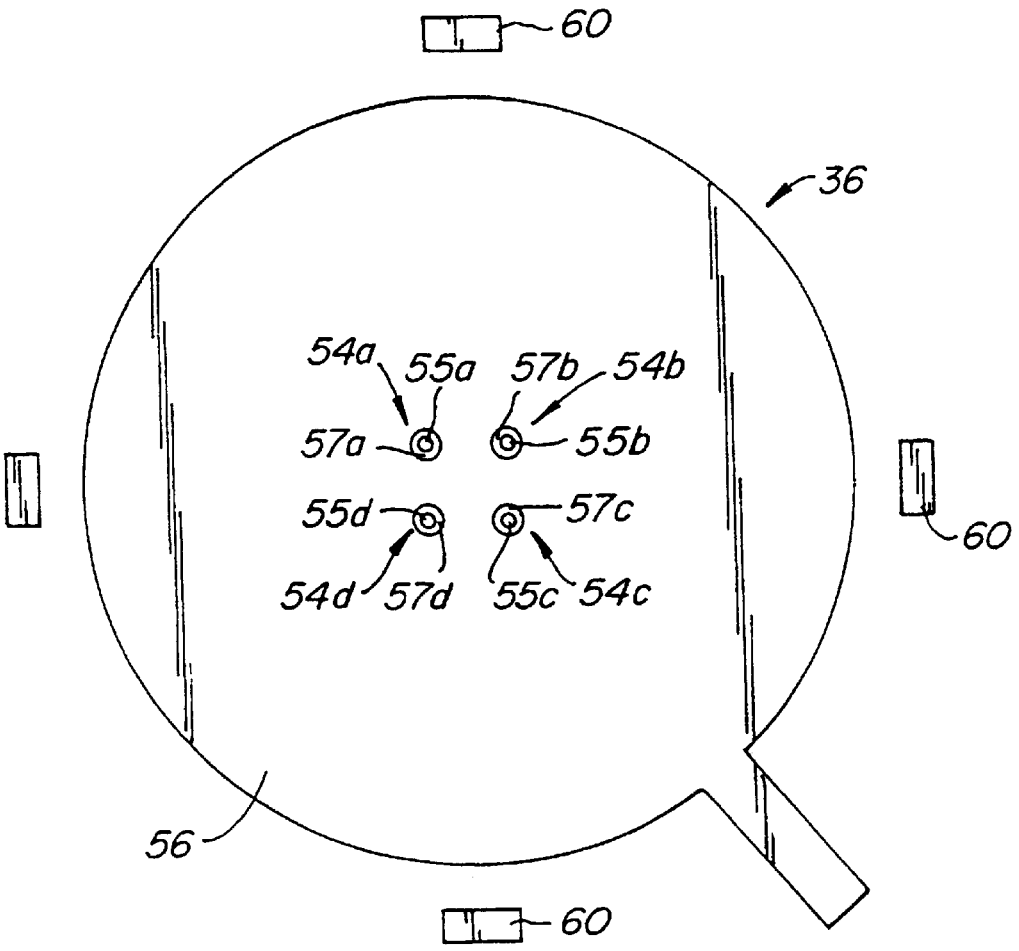
FIG. 5 is a plan view of another embodiment of an electrically conductive surface on a substrate of the pointing device of FIG. 2.

FIG. 5 shows another embodiment of the electrically conductive surface 36 which includes a plurality of inner switch contacts 54*a*, 54*b*, 54*c*, 54*d* that each comprise an electrically conductive center 55*a*, 55*b*, 55*c*, 55*d* separated from an electrically conductive exterior 56*a*, 56*b*, 56*c*, 56*d* by a nonconductive electrical switch gap or ring 57*a*, 57*b*, 57*c*, 57*d*. The inner switch contacts 54*a*, 54*b*, 54*c*, 54*d* are close to and substantially symmetrically spaced from the center of the conductive surface 36 which is aligned with the axis of the stick 28, and are generally similar in structure to the switch contact 42 of FIG. 4. The area of the electrically conductive center 55*a* (55*b*, 55*c*, 55*d*) and the width of the nonconductive electrical switch ring 57*a* (57*b*, 57*c*, 57*d*) of each inner switch contact 54*a* (54*b*, 54*c*, 54*d*) are desirably small compared to the area of the resistive surface 20. As in the embodiment of FIG. 4, each nonconductive ring 57*a* (57*b*, 57*c*, 57*d*) may be formed by part of the substrate. FIG. 5 shows a plurality of electrical contact pads 60 (e.g., east, west, north, south) that may be provided for supplying the voltage variance to the resistive surface 20 of the resistive boot 12. As discussed above, other configurations and methods of providing the voltage variance may be used.

When the resistive surface 20 is deflected by applying a force on the stick 28 which is aligned with the center of the conductive surface 36, it initially makes contact with the electrically conductive surface 36 near the center of the conductive surface 36. Under a normal force, the resistive surface 20 does not form an electrical contact with the switch contacts 54*a*, 54*b*, 54*c*, 54*d* to activate the contacts as they are spaced from the center of the conductive surface 36. Even when the resistive surface 20 is rolled on the electrically conductive surface 36, it does not contact more than one of the switch contacts. When the force on the resistive surface 20 is increased by pressing harder on the stick 28, the resilient resistive surface 20 deforms and the footprint of the surface 20 is enlarged to be able to contact two of the switch contacts 54*a*, 54*b*, 54*c*, 54*d* at the same time, bridging the two switch contacts for activation. Because of the generally square configuration, the resistive surface is more like to contact two adjacent switch contacts rather than two diagonally disposed switch contacts. In one embodiment, each of the pair of diagonally disposed switch contacts are connected to the same electrical point and adjacent switch contacts are connected to different electrical points. Therefore, switch activation only occurs with a force higher than a normal force on the stick 28 to make contact between the resistive surface 20 and two switch contacts. The configuration with the switch contacts 54*a*, 54*b*, 54*c*, 54*d* may be used for a range or applications as known to those of ordinary skill in the art.

The resilient boot 12 of the pointing device 10 can provide multiple continuous paths of substantially uniform resistance for generating variable signals. The continuous resistive path is equivalent to a large number of discrete resistance points for improved performance. As discussed above, the variable signals are generated by a voltage variance produced by.voltage sources or the like. In certain applications such as traditional joysticks, four paths are used (namely, east, west, north, and south) as produced by the four contact pads 60 (FIG. 5). The resilient boot 12 allows more paths to be added easily.

Figure 6:
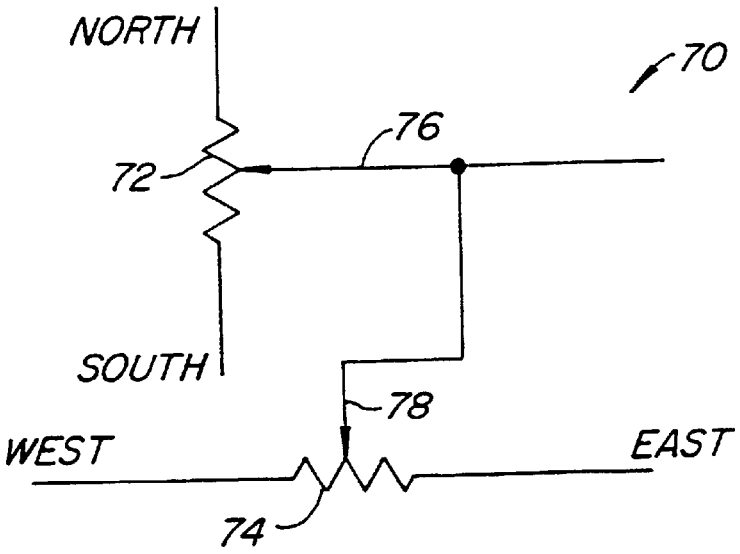
FIG. 6 is a schematic view illustrating the circuit representation of the pointing device of FIG. 2.

FIG. 6 schematically illustrates the circuit representation 70 of the pointing device 10 with four paths (east, west, north, south) defining two axes (east-west axis and north-south axis). The north-south axis is represented by the resistive path 72, while the east-west axis is represented by the resistive path 74. The circuit 70 includes a north-south wiper 76 which is in movable contact along the north-south path or axis 72 and an east-west wiper 78 which is in movable contact along the east-south path or axis 74. The movement of the north-south wiper 76 (and east-west wiper 78) represents rolling contact movement of the resistive surface 20 of the resilient boot 12 over the electrically conductive surface 36 in the north-south direction (and in the east-west direction). The locations of the wipers 76, 78 determine the variable signals, and represent the location of the resistive surface 20 on the electrically conductive surface 36.

The pointing device 10 is compact and simple, and has only two components, namely, the resistive diverter 12 and the substrate 16 with the electrically conductive surface 36. The resistive diverter 12 is the only moving part. The resistive diverter 12 encloses the electrically conductive surface 36, making it impervious to external environmental effects. The pointing device 10 can be miniaturized and built into a notebook or standard computer. It can also be used in remote control devices.

Figure 7:
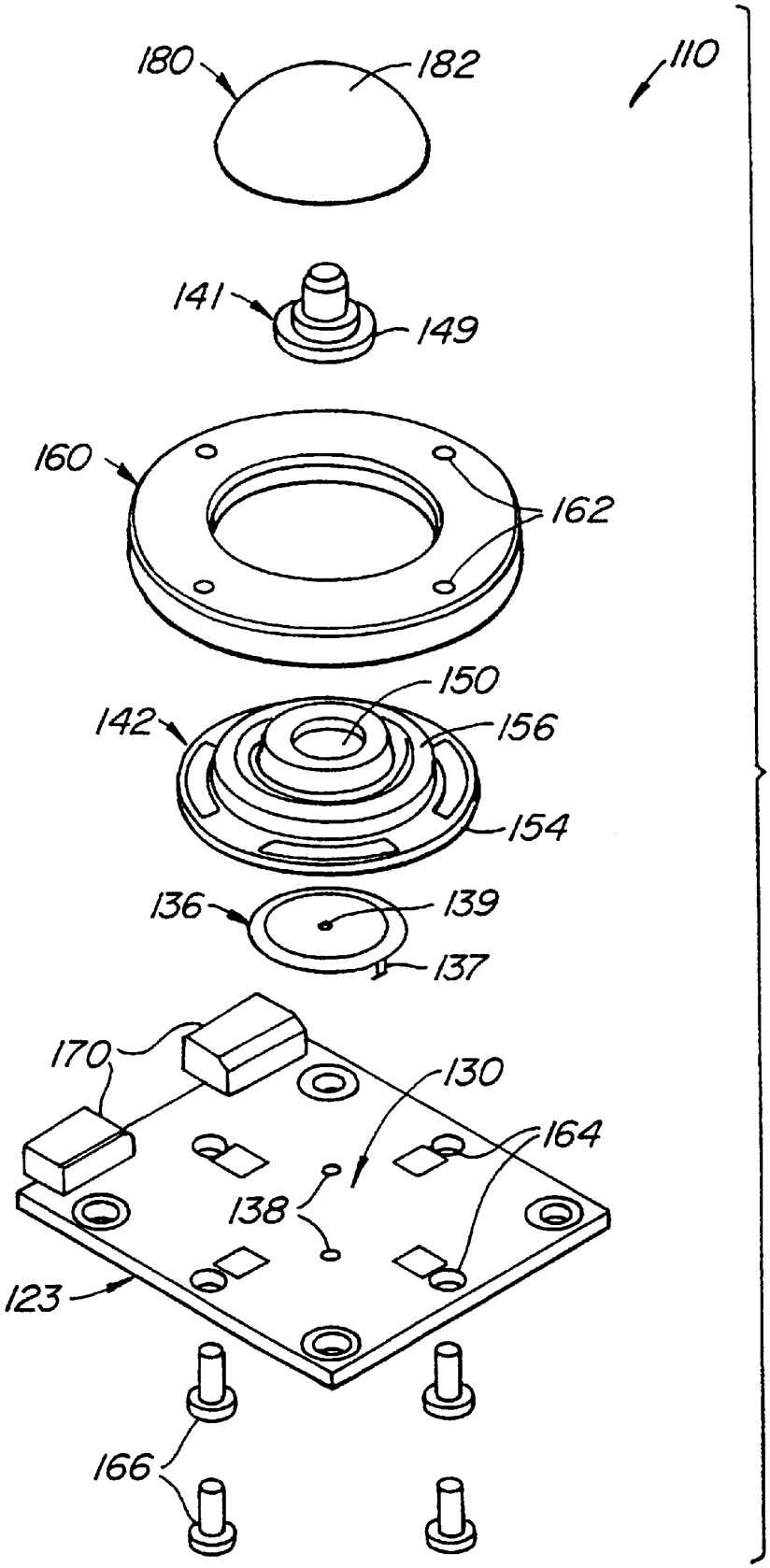
FIG. 7 is an exploded perspective view illustrating another embodiment of a pointing device of the present invention.

Referring to FIG. 7, another embodiment of a pointing device 110 includes a substrate or printed circuit board 123 which desirably has an area of a continuous upper substrate surface 130 as shown. This embodiment of the pointing device 110 employs an integrated switch such as a dome switch 136 as shown. The dome switch 136 in this embodiment has a curved top with legs 137 that connect the switch 136 to the substrate 123 via apertures 138 in the substrate 123. The dome switch 136 collapses when depressed. An optional small dimple 139 may be included at the center of the dome switch 136 for centering purposes as discussed below. The pointing device 110 comprises a base pivot 141 and a resilient return member 142. The pivot 141 has a protrusion or boss 149 at the bottom. The boss 149 is shaped to cooperate in a fitted manner with the cavity of a seat 150 provided in the return member 142, as best seen in the assembled pointing device 110 of FIG. 8. The return member 142 has sufficient resiliency to allow the boss 149 to fit into the cavity of the seat 150 to secure easily the pivot 141 and the return member 142 together. The design also makes it convenient to separate the pivot 141 from the return member 142 and replace the pivot 141 with another member of a different shape.

Figure 8:
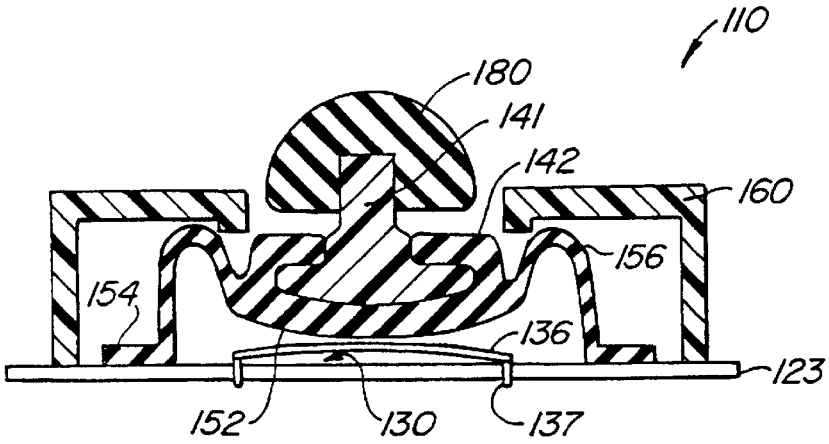
FIG. 8 is a partial cross-sectional view illustrating the pointing device of FIG. 7 in an undeflected mode.

The return member 142 has a resistive surface 152 (FIGS. 8 and 9) disposed below the seat 150. The resistive surface 152 is desirably curved with a convex shape similar to the resistive surface 20 of the pointing device 10 of FIG. 2. The outer edge 154 of the return member 142 is also similar to the outer edge 18 of the resilient boot 12 of the pointing device 10 and connects the return member 142 to the substrate 123 as shown in FIG. 8. An annular arch 156 connects the seat 150 to the outer edge 154 of the return member 142. The dome switch 136 is desirably disposed below the center area of the resistive surface 152 which is closest to the upper substrate surface 130 in the undeformed state. The surface of the dome switch 136 may be an active part of the circuit to allow microprocessor firmware capability, as discussed below.

An optional lock ring 160 can be placed over the resilient return member 142 to constrain it relative to the substrate 123 (alternatively, the return member 142 can be connected directly to the substrate 123). The lock ring 160 includes a plurality of apertures 162 that match the openings 164 in the substrate 123. A plurality of mounting screws 166 couple the lock ring 160 and substrate 123 via the apertures 162 and openings 164 (for simplicity, these connections are not shown in FIGS. 8 and 9). Mounted on the substrate 123 is an optional input header 170 for providing connection between the leads or wiring within the pointing device 110 to external devices such as a microprocessor (e.g., microcontroller 6 in FIG. 1). An optional control device 180 is placed over the pivot 141 to provide a control surface 182 for contact with human fingers or hand.

Figure 9:
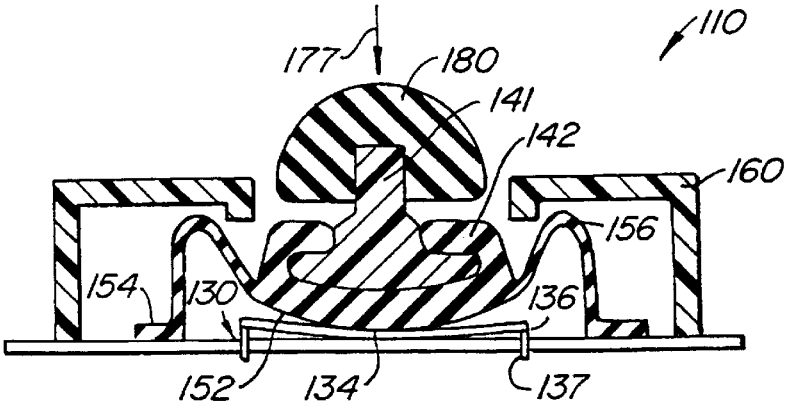
FIG. 9 is a partial cross-sectional view illustrating the pointing device of FIG. 7 in a deflected mode.
Figure 10:
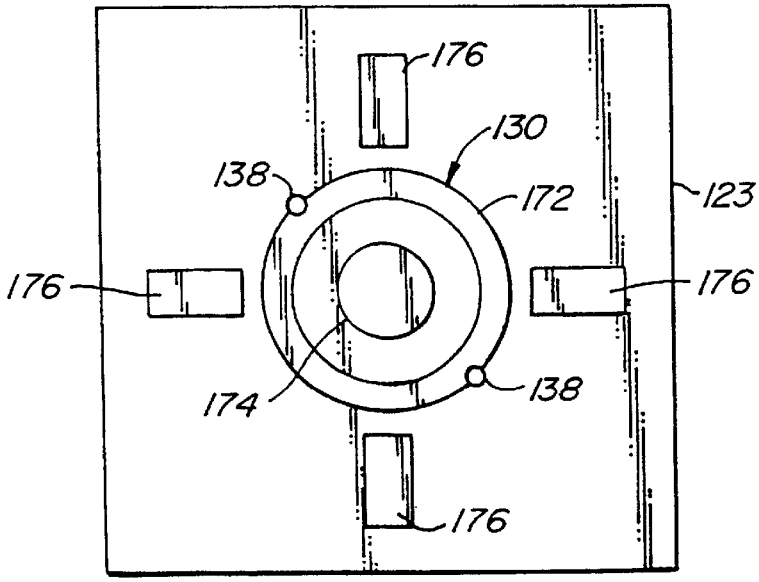
FIG. 10 is a plan view of an embodiment of an electrically conductive surface on a substrate of the pointing device of FIG. 7.

FIG. 8 shows the pointing device 110 in the undeflected mode and FIG. 9 shows the pointing device 110 in the deflected mode with the dome switch 136 in a collapsed mode. An embodiment of the electrically conductive surface 130 as illustrated in FIG. 10 includes an outer conductive ring 172 coupled to the apertures 138 and a center conductive area 174 spaced from the conductive ring 172 and under the dome switch 136. FIG. 10 shows a plurality of electrical contact pads 176 (e.g., across the east-west axis 74 and the north-south axis 72) that are provided for supplying the voltage variance to the resistive surface 152 of the return member 142.

In operation, the resistive surface 152 makes contact with the top surface of the dome switch 136 under a force in direction 177 to form a contact location 134 and provide the variable resistance or voltage of the device 110. As the resistive surface 152 is rolled on the top surface of the dome switch 136, the contact location 134 between the resistive surface 152 and the dome switch 136 is changed. Pressing down further on the return member 142 deflects or collapses the dome switch 136 downward to contact the center conductive area 174 in the deflected mode, as shown in FIG. 9. This switch closure causes the voltage or resistance value of the device 110 to be transferred to the center conductive area 174. The signal on the center contact area can then be conditioned to be a digital input or left as an analog signal. This operation of the pointing device 110 emulates a left-button mouse click.

The dome switch 136 provides additional functional features. The first is a drag function, which is easily understood in the context of a mouse pointer, where the finger depresses the left button of a mouse and holds it down while dragging the mouse. A drag function is difficult to perform using the earlier embodiment of the pointing device 10 of FIG. 2. The integrated dome switch 136 solves the problem by collapsing under the depression of the pivot 141 and return member 142 to simulate the hold-down feature. A collapsed dome switch 136, however, does not provide an ideal surface for contact with the resistive surface 152 to generate data. Thus, the pointing device 110 is advantageously modified by providing firmware associated with the dome switch 136 (e.g., in a processor such as the microcontroller 6 of FIG. 1). In the drag mode, when the user holds the pivot 141 and return member 142 down collapsing the dome switch 136 for a specified, short period of time (e.g., between about 0.25 and 0.5 second) and then release, the pointing device 110 acts as if the return member 142 remained depressed with the dome switch 136 collapsed. Movement of the pivot 141 on top of the dome switch 136 (e.g., in east/west and north/south directions) effects the drag function. To cancel or drop the drag function, the user simply depresses the pivot 141 and return member 142 one more time to collapse the dome switch 136, and release. This completes a "drag and drop" scenario.

The optional dimple 139 at the center of the dome switch 136 is oriented upward. When the return member 142 is depressed, it will in most instances make initial contact with the center of the dome switch 136. This allows firmware embedded in the microprocessor to calibrate the resistive return member 142 using the detected resistance value at the center dimple 139 as a reference value in the event that there is any imperfections (e.g., lack of homogeneous resistance) in the resistive surface 152 and resistive material of the return member 142.

The resilient return member 142, including the resistive surface 152, may be made of low durometer rubber. The pivot 141 and the control device 180 may be made of the same material as the return member 142, or may be made of other materials such as a hard plastic. The material and geometry of the return member 142 are selected to facilitate repeat deformation and reformation of the return member 142 between the deflected and undeflected mode. The dome switch 136 is typically made of stainless steel, phosphor bronze, other steel materials, or the like The configuration of the pointing device 110 provides certain advantages. For instance, the separate pivot 141 (as well as control device 180) can isolate and insulate the user's hand from the electrical circuitry and components that include the resistive surface 152 of the return member 142 and the electrically conductive surface 130 of the substrate 123. Moreover, the boss 149 is shaped to cooperate in a fitted manner with the cavity of a seat 150 provided in the return member 142. The boss 149 and seat 150 combination allows the thickness of the portion of the return member 142 adjacent the resistive surface 152 to be relatively thin. As a result, the return member 142 of the pointing device 110 tends to deform and reform more smoothly and reliably.

Many other configurations of the pointing device similar to those shown (10, 110) are possible.

Figure 11:
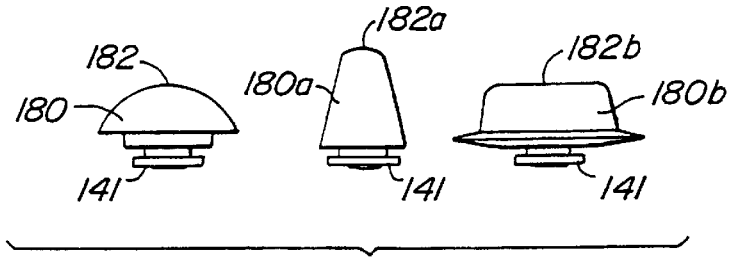
FIG. 11 is an elevational view illustrating three embodiments of a control surface component for the pointing device of FIG. 7.

FIG. 11 shows other possible configurations for the control device 180. The first control-device 180 is referred to as an orb controller because of the shape of its control surface 182 and orbit-like movement. The second control device 180*a* is a stick having a joystick-like control surface 182*a*, while the third control device 180*b* is a disc with a disc-like control surface 182*b*. The surfaces 182, 182*a*, 182*b* of the control devices 180, 180*a*, 180*b* may each include a grip pattern such as a cross-cut texture (not shown) for ease of handling by a human hand or finger. The control devices 180, 180*a*, 180*b* each extend generally perpendicularly to the upper surface 130 of the substrate 123, and typically are substantially symmetrical relative to their axes.

The disc 180*b* can create the risk for repetitive stress disorder because it induces the joint of the digit of the hand to attempt a rotational movement in the east/west axis (laterally), which causes stress to the joints. The stick 180*a* has the advantage of better ergonomic design than the disc pad 180*b* because it allows the digit to move laterally without stress to the associated joints of the hand, which means that it is more comfortable to use and less likely to cause any joint damage. On the other hand, it has the disadvantage of taking more vertical space, which makes it potentially more difficult to physically fit the stick 180*a* inside a device such as a remote control and to prevent accidental deflection. The orb controller 180 combines the advantages of a small height dimension of the disc 180*b* and an ergonomic design of the stick 180*a*. In use, the rocking motion created between the resistive surface 152 of the return member 142 and the electrically conductive surface 130 of the substrate 123 causes the orb controller 12 as well as the return member 142 to rotate. The rotation of the control surface 182 of the controller 180 eliminates the need to rotate the joint of the digit when manipulating the controller 180 to move in the east/west direction (as well as other substantially lateral directions). As a result, the possibility of repetitive stress is greatly reduced.

Figure 12:
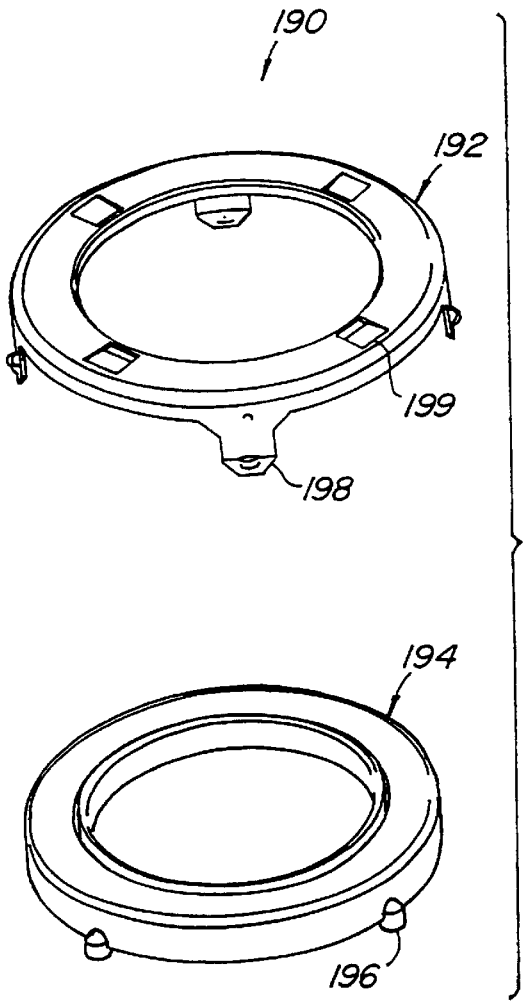
FIG. 12 is an upper exploded perspective view of another embodiment of a lock ring for the pointing device of FIG. 7.
Figure 13:
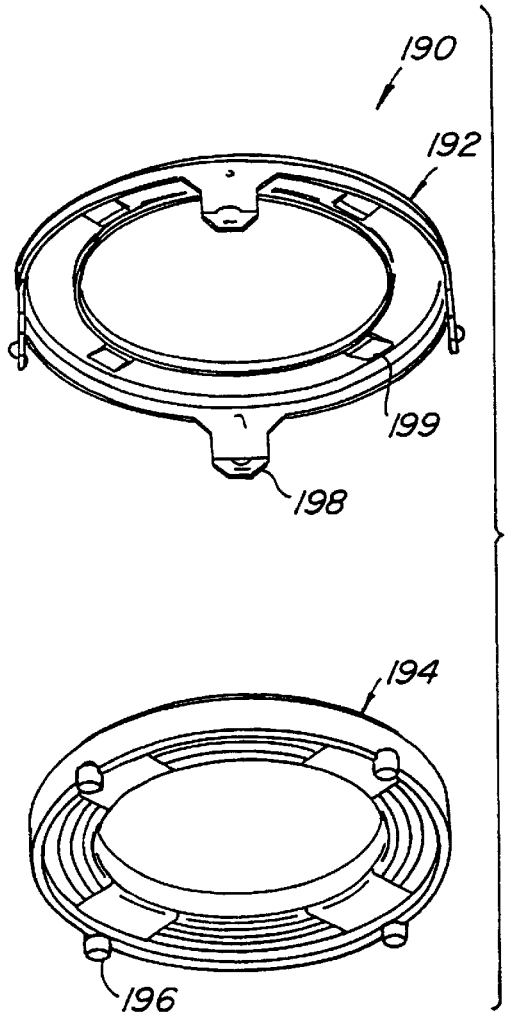
FIG. 13 is a lower exploded perspective view of the lock ring of FIG. 12.

It will be understood that the above-described arrangements of apparatus and methods therefrom are merely illustrative of applications of the principles of this invention and many other embodiments and modifications may be made without departing from the spirit and scope of the invention as defined in the claims. For instance, FIGS. 12 and 13 illustrate another embodiment of a snap lock ring 190 that can replace the lock ring 160 of FIG. 7 and eliminate the need for the mounting screws 166. The snap lock ring 190 shown includes a snap ring 192 that is typically made of a metal or similar material with sufficient strength or tension to lock the components down on the substrate 123. An insulating ring 194 typically made of nonconductive polymer is placed between the snap ring 192 and the return member 142 of FIG. 7. The insulating ring 194 has pins 196 that are used to position it over alignment apertures provided on the substrate 123. The snap ring 192 includes snap members 198 that are resiliently biased and snap into position through openings (not shown) provided in the substrate 123. The snap members 198 facilitate easy and quick assembly and disassembly of the snap lock ring 190. The snap ring 192 desirably includes holding flaps or portions 199 that exert forces on the insulating ring 194 to ensure that the insulating ring 194 and the components below (such as the return member 142) stay in position. The use of metal or other strong material is suitable to provide sufficient strength for the snap ring 192. Alternatively, the metal snap ring 192 and insulating ring 194 can be replaced by a single snap lock ring (not shown) that is insulating yet possesses sufficient strength to lock the components onto the substrate 123. Suitably strong polymer, composite material, or the like can be used.

What is claimed is:

1. A pointing device comprising:

a substrate having an electrically conductive surface;

a resilient return member supported by the substrate along an outer edge, the return member spaced from the electrically conductive surface in a rest mode and displaceable relative to the substrate by a force and resiliently returning to the rest position with removal of the force, the return member having a voltage variance over a resistive rocking surface of the return member, the resistive rocking surface displaceable to contact a portion of the electrically conductive surface at an electrical contact position to generate a signal through the electrically conductive surface with the voltage variance in a pressed mode, the resistive rocking surface displaceable to rock on the electrically conductive surface to change the electrical contact position between the resistive rocking surface and the electrically conductive surface to produce a corresponding change in the signal.

2. The pointing device of claim 1, wherein the return member is substantially circular.

3. The pointing device of claim 1, wherein the return member comprises an annular bellow connected between the resistive rocking surface and the outer edge.

4. The pointing device of claim 1, wherein the resistive rocking surface is convex.

5. The pointing device of claim 1, wherein the return member comprises resistive material.

6. The pointing device of claim 5, wherein the resistive material comprises resistive rubber.

7. The pointing device of claim 6, wherein the resistive rubber material comprises rubber embedded with carbon or other conductive material.

8. The pointing device of claim 1, wherein the plurality of spaced contacts comprises two pairs of equally spaced opposite contacts, each the pair of opposite contacts being energized with a voltage potential.

9. The pointing device of claim 1, wherein the resistive rocking surface has a resistance of under about 50 kilo-ohms.

10. The pointing device of claim 9, wherein the resistive rocking surface has a resistance of about 1,000 to about 25,000 ohms, more preferably about 1,000 to 10,000 ohms.

11. The pointing device of claim 1, wherein the resistive rocking surface has a substantially uniform resistance.

12. The pointing device of claim 1, wherein the return member has electrical contact with a plurality of spaced contacts distributed adjacent the outer edge, the plurality of spaced contacts being voltage-potential-energized to form the voltage variance.

13. The pointing device of claim 1, wherein the electrically conductive surface comprises at least one electrical switch separated from an outer conductive portion by a nonconductive switch ring, the at least one electrical switch activated with the resistive rocking surface connecting the switch and the outer conductive portion across the nonconductive switch ring.

14. The pointing device of claim 13, wherein the at least one electrical switch comprises a conductive material.

15. The pointing device of claim 13, wherein the return member comprises a control member extending from the resistive rocking surface and generally aligned with the center region of the electrically conductive surface.

16. The pointing device of claim 1, further comprising a digital wake up device which activates the plurality of spaced contacts to produce the voltage variance over the resistive rocking surface only when the resistive rocking surface contacts the electrically conductive surface.

17. A pointing device comprising:

an electrically conductive surface; and a return member including a resistive rolling surface having a voltage variance and means for resiliently supporting the resistive rolling surface in an undeflected mode spaced from the electrically conductive surface, the resistive rolling surface being movable to contact a portion of the electrically conductive surface and to roll over the electrically conductive surface to contact a different portion of the electrically conductive surface in a deflected mode.

18. The pointing device of claim 17, wherein the means comprises a flexible member connecting the resistive rolling surface to a substrate fixed relative to the electrically conductive surface.

19. The pointing device of claim 18, wherein the flexible member is generally annular having an inner edge connected to the resistive rolling surface and an outer edge connected to the substrate.

20. The pointing device of claim 18, wherein the flexible member comprises a bellow.

21. The pointing device of claim 18, wherein the flexible member comprises resistive rubber.

22. The pointing device of claim 21, wherein the resistive rubber comprises carbon or other conducting material embedded in rubber.

23. The pointing device of claim 17, wherein the return member comprises a pivot coupled to a control member.

24. The pointing device of claim 23, wherein the control member comprises a stick, a disc, or a curved dome-like member.

25. The pointing device of claim 17, further comprising a lock ring for attaching the return member to the electrically conductive surface.

26. The pointing device of claim 25, wherein the lock ring includes a plurality of snap members for resiliently snapping onto openings through the electrically conductive surface.

27. The pointing device of claim 25, wherein the lock ring includes an outer ring and an insulating ring member disposed between the outer ring and the return member.

28. The pointing device of claim 17, further comprising a collapsible conductive dome switch disposed between the resistive rolling surface and the electrically conductive surface.

29. The pointing device of claim 28, wherein the dome switch includes a dimple at a center.

30. The pointing device of claim 28, wherein the dome switch is associated with firmware for performing a drag function when the dome switch is deformed to collapse for a specified period of time and reformed, and for removing the drag function when the dome switch is again deformed to collapse and reformed.

31. The pointing device of claim 28, wherein the electrically conductive surface comprises an outer conductive ring coupled to the dome switch and a center conductive area spaced from the conductive ring and disposed under the dome switch.

32. A pointing device comprising:

a substrate having an electrically conductive surface;

a return member including a resistive rocking surface which is energizable with a voltage variance, the resistive rocking surface of t he return member being resiliently supported to contact the electrically conductive surface at an electrical contact position to generate a signal with the voltage variance, the resistive rocking surface of the return member being displaceable to rock on the electrically conductive surface to change the electrical contact position between the resistive rocking surface of the resilient member and the electrically conductive surface of the substrate to produce a corresponding change in the signal.

33. The pointing device of claim 32, wherein the return member comprises a pivot coupled to a control member.

34. The pointing device of claim 33, wherein the control member comprises a stick, a disc, or a curved dome-like member.

35. The pointing device of claim 32, further comprising a lock ring for attaching the return member to the electrically conductive surface.

36. The pointing device of claim 35, wherein the lock ring includes a plurality of snap members for resiliently snapping onto openings through the electrically conductive surface.

37. The pointing device of claim 35, wherein the lock ring includes an outer ring and an insulating ring member disposed between the outer ring and the return member.

38. The pointing device of claim 32, further comprising a collapsible conductive dome switch disposed between the resistive rocking surface and the electrically conductive surface.

39. The pointing device of claim 38, wherein the dome switch includes a dimple at a center.

40. The pointing device of claim 38, wherein the dome switch is associated with firmware for performing a drag function when the dome switch is deformed to collapse for a specified period of time and reformed, and for removing the drag function when the dome switch is again deformed to collapse and reformed.

41. The pointing device of claim 38, wherein the electrically conductive surface comprises an outer conductive ring coupled to the dome switch and a center conductive area spaced from the conductive ring and disposed under the dome switch.

* * * * *